US007587978B1

(12) United States Patent
Mock, Jr. et al.

(10) Patent No.: US 7,587,978 B1
(45) Date of Patent: Sep. 15, 2009

(54) REACTIVE MATERIAL INITIATOR FOR EXPLOSIVE-FILLED MUNITIONS

(75) Inventors: Willis Mock, Jr., Fredericksburg, VA (US); Bradley L. Hanna, Fredericksburg, VA (US); William H. Holt, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/974,005

(22) Filed: Sep. 27, 2007

(51) Int. Cl.
*F42C 1/04* (2006.01)

(52) U.S. Cl. ..... 102/204; 102/205

(58) Field of Classification Search ..... 102/204, 102/205, 499, 500, 382, 396, 439, 473, 488, 102/363

See application file for complete search history.

(56) References Cited

U.S. PATENT DOCUMENTS

| | | | | | |
|---|---|---|---|---|---|
| 708,411 | A | * | 9/1902 | Semple | 102/513 |
| 1,382,750 | A | * | 6/1921 | Sprague et al. | 102/499 |
| 2,652,776 | A | * | 9/1953 | Catlin | 102/500 |
| 3,599,570 | A | * | 8/1971 | Ingersoll et al. | 102/499 |
| 3,961,576 | A | * | 6/1976 | Montgomery, Jr. | 102/491 |
| 4,619,200 | A | * | 10/1986 | Bell | 102/275 |
| 4,676,163 | A | * | 6/1987 | Bell | 102/204 |
| 5,311,820 | A | | 5/1994 | Ellingsen | 102/481 |
| 5,554,816 | A | | 9/1996 | Skaggs et al. | 89/36.17 |
| 5,780,766 | A | | 7/1998 | Schröppel | 102/372 |
| 7,363,860 | B2 | | 4/2008 | Wilson et al. | 102/205 |

OTHER PUBLICATIONS

"Reactive material" http://en.wikipedia.org/wiki/Reactive_material.

W. H. Holt, W. Mock Jr., W. G. Soper, C. S. Coffey, V. Ramachandran & R. W. Armstrong, "Reverse-ballistic impact study of shear plug formation and displacement in Ti6A14V alloy", *J. Appl. Phys.*, 73 (8), Apr. 15, 1993, 3753-3759.

* cited by examiner

*Primary Examiner*—Michael Carone
*Assistant Examiner*—Reginald Tillman, Jr.
(74) *Attorney, Agent, or Firm*—Gerhard W. Thielman, Esq.

(57) ABSTRACT

An initiator is provided for a munitions device that is intended to strike a target substantially along a trajectory direction and contains an explosive within a case. The initiator includes a sleeve, first and second anvils and an initiation pellet disposed between the anvils. The sleeve is disposed within the case and adjacent to the explosive, and defines an initiator interior aligned substantially parallel to the trajectory direction. The sleeve includes one or more orifices that extend therethrough between the explosive and the interior, the orifices being disposed adjacent to the pellet. The pellet is composed of a reactive material that chemically responds as a non-explosive to kinetic and thermal stimuli. The first anvil is disposed transverse to the interior and forward of the pellet, while the second anvil is disposed within the interior behind of the pellet, wherein the second anvil translates towards the first anvil substantially along the trajectory direction in response to the device striking the target. The pellet discharges particles through the orifices, the particles being directed into the explosive in response to the second anvil translating towards the first anvil. The sleeve can be disposed within the explosive. The reactive material can be a solid or powdered mixture of powdered aluminum and polytetrafluoroethylene or other fluoropolymer, or alternatively a thermite mixture of powdered metal and metal oxide and may include added polytetrafluoroethylene or other fluoropolymer.

20 Claims, 5 Drawing Sheets

REACTIVE MATERIAL INITIATOR FOR EXPLOSIVE-FILLED MUNITIONS

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to initiation devices for explosives. In particular, the invention relates to an initiator using reactive materials to reduce shock and thermal sensitivity for improved safety.

The United States Department of Defense (DoD) has sought to transition to an insensitive munitions (IM) inventory of weapons since 1999. In particular, IM compliant warheads and rocket motor are intended to diminish sensitivity to shock and/or to reduce reaction intensity in response to thermal cook-off. This enables assigning such munitions to a lower hazard classification, thereby mitigating costs for storage, transportation and handling logistics.

Conventional initiators for DoD weapons contain primary explosives. These chemicals include lead azide ($PbN_6$), lead styphnate ($C_6H_3N_3O_8Pb$) and diazodnitrophenol (DDNP, $C_6H_2N_4O_5$). Such highly reactive chemicals are typically very sensitive to un-commanded shock and thermal initiation, making them potential safety hazards and are not compliant with the current Insensitive Munitions strategy. The United States Department of Transportation (DoT) lists such substances as Class 1.1A Explosives under 49 CFR §172.101 in the Hazardous Materials Table.

SUMMARY

Conventional initiators yield disadvantages addressed by various exemplary embodiments of the present invention. In particular, various exemplary embodiments provide an initiator that incorporates reactive materials, rather than explosive materials. Other various embodiments alternatively or additionally provide for concatenated initiators of such configuration.

Various exemplary embodiments provide an initiator for a munitions device intended to strike a target substantially along a trajectory direction. The device contains an explosive within a case. The initiator includes a sleeve, first and second anvils and an initiation pellet disposed between the anvils. The sleeve is disposed within the case and adjacent to the explosive, and defines an initiator interior aligned substantially parallel to the trajectory direction. The sleeve includes one or more orifices that extend therethrough between the explosive and the interior, the orifices being disposed adjacent to the pellet. The pellet is composed of a reactive material that chemically responds as a non-explosive to kinetic and thermal stimuli.

The first anvil is disposed transverse to the interior and forward of the pellet, while the second anvil is disposed within the interior behind of the pellet, wherein the second anvil translates towards the first anvil substantially along the trajectory direction in response to the device striking the target. The pellet discharges particles through the orifices, the particles being directed into the explosive in response to the second anvil translating towards the first anvil. The sleeve may be disposed within the explosive. In various exemplary embodiments, the reactive material may be a solid or powdered mixture of powdered aluminum and polytetrafluoroethylene (or other fluoropolymers), or alternatively a thermite mixture of powdered metal and metal oxide (and may include polytetrafluroethylene or other fluoropolymers).

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The embodiments described herein employ a reactive material rather than an explosive material. A reactive material represents a flammable substance that exothermally reacts by burning in response to a kinetic or thermal stimulus that exceeds the high threshold to initiate chemical response. By contrast, an explosive material combusts rapidly (i.e., by explosion or deflagration) in response to comparatively low threshold of received energy.

Figure 1:
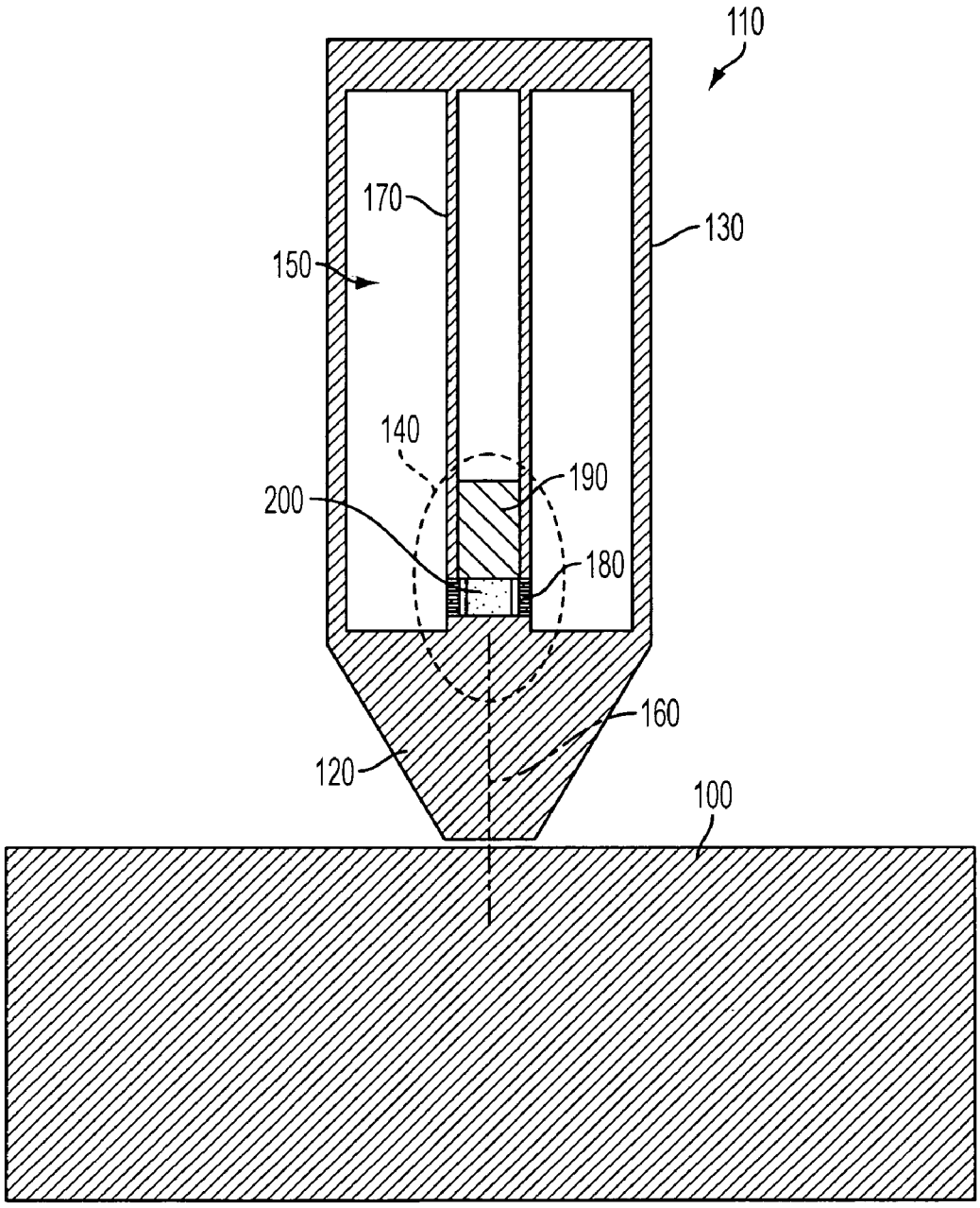
FIG. 1 is an elevation view of an explosive projectile with an initiator in accordance with a first embodiment prior to impact.

Exemplary embodiments provide an initiator that includes a disk of solid reactive material with a metal disk on either longitudinal side attached to each face of the reactive material as shown in FIG. 1 as an axi-symmetric elevation cross-section. Artisans of ordinary skill will recognize that the cylindrical configuration as depicted is exemplary only and not limiting. The metal disks represent a hammer and an anvil respectively between which the reactive disk may be disposed.

This reactive material may incorporate, for example, a solid mixture of powdered aluminum and polytetrafluoroethylene (PTFE, also known as Teflon®). The reactive material may instead or additionally incorporate other fluoropolymers besides PTFE. Such materials are classified as flammable solids, rather than explosives, and thus involve less stringent handling requirements. Alternatively, other reactive materials may be used, such as a metal and metal oxide thermite mixture that may include added polytetrafluroethylene and/or other fluoropolymers.

For low velocity impact of the projectile against a target, a powdered mixture of aluminum and PTFE may be used for the reactive material in the initiator, because a solid mixture of aluminum and PTFE requires more kinetic energy to initiate. Other exemplary embodiments may include a series of reactive disks separated by metal disks between them. The series may be located along the centerline of the weapon or along an offset to the centerline. Alternatively, the initiator may consist of a series of reactive disks and metal anvils arranged parallel to the centerline.

In particular, FIG. 1 shows a target 100 being approached by a warhead projectile or weapon 110, such as a bomb, bullet, or missile launched thereagainst. To enhance penetration, the projectile 110 includes a hardened nose 120, composed from a structurally rigid material, such as steel. Behind (i.e., aft of) the nose 120, the projectile 110 includes a case 130 containing an initiator 140 and an explosive fill region 150 disposed annularly around the projectile's longitudinal axis or centerline 160. The initiator 140 and explosive fill 150 may be separated by an axi-symmetric sleeve or housing 170 that includes angularly disposed vent holes or orifices 180. The centerline 160 may be substantially parallel to and preferably co-linear with a trajectory direction of the projectile 110 towards the target 100. The orientation represented for the projectile 110 identifies the lower end (adjacent the target 100) as forward and the upper (or distal) end as aft.

The explosive fill region 150 may be disposed in an annular torus or annulus disposed around the sleeve 170. The initiator 140 includes a metal disk or anvil 190 and a reactive material disk or initiation pellet 200 along the centerline 160 disposed within the interior of the sleeve 170. The metal disk 190 may be composed of a substantially rigid metal, such as steel. The reactive disk 200 may be confined longitudinally between the nose 120 (representing an upstream anvil) and the metal disk 190 (representing a downstream hammer), and also restrained radially by the sleeve 170.

The sleeve 170 may include a void behind of the metal disk 190. Alternatively, such a void in the sleeve 170 may be forward of the metal disk 190, provided that the latter's translation through the former remains unimpeded. The metal disk 190 may be restrained to avoid translation along the centerline 160 during launch or gun-ejection.

Those of ordinary skill will recognize that although an axi-symmetric cylindrical disk is depicted, alternative solid shapes may be used to be represented by the term "disk" as provided in the instant disclosure. Alternatively, the nose 120 may include an additional metal disk (not shown) between the nose 120 and the reactive disk 200, thereby enabling the nose 120 to have a less rigid composition. The initiator 140 may be activated to ignite the explosive in the fill region 150 when the projectile 110 violently contacts (i.e., striking) the target 100.

Thicknesses of the metal and reactive disks 190, 200 may be tailored to determine the optimum time for initiation, namely to tune the initiation time for the selected explosive material for the fill region 150 and its geometry. Typically, the reactive disk 200 may possess a shorter axial length (i.e., in the longitudinal direction) than the metal disk 190, and optionally may also have a slightly smaller radius. Alternatively or in addition, the particle size of the aluminum powder may additionally or alternatively be used to tune the initiation sensitivity, as laboratory experiments demonstrate significant dependency of the initiation time of the reactive material on the aluminum particle size.

Figure 2:
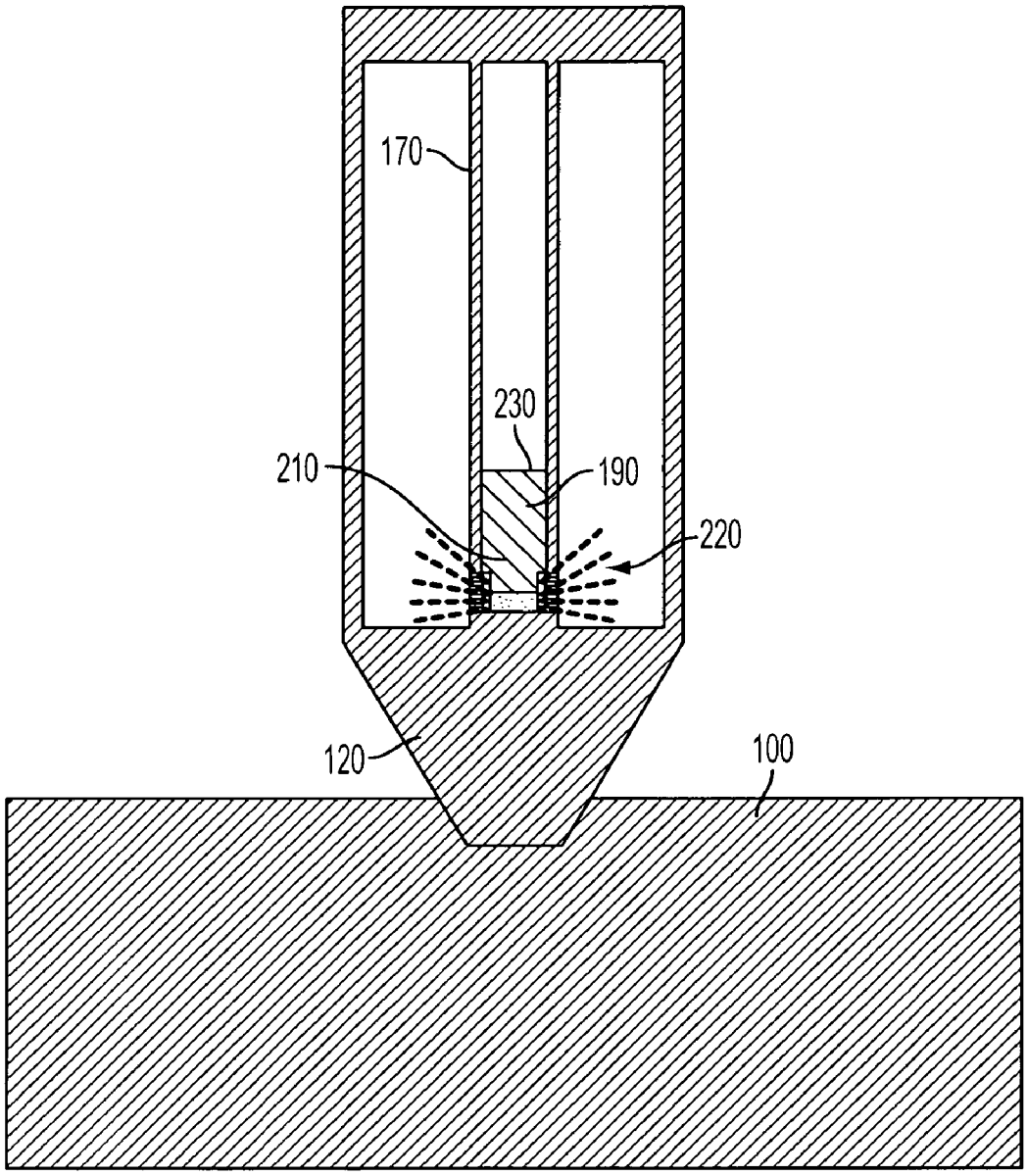
FIG. 2 is an elevation view of an explosive projectile with an initiator in accordance with a first embodiment upon impact.

The reactive material initiator 140 may be disposed in the sleeve 170 radially inward of the explosive fill region 150 (annularly extending from the sleeve) of the projectile 110. As shown in FIG. 2, upon impact with the target 100 (having traveled in the trajectory direction), the momentum and mechanical energy of the projectile 110 in flight may be converted to compress the reactive disk 200 to deform as flattened disk 210. Alternatively, multiple disks, as shown in tandem between corresponding anvils in FIG. 4 and discussed subsequently, may be employed.

As the compressed disk 210 squeezes, reactive material discharges through the vent holes 180 into the explosive fill 150 as hot glowing reactive particles 220. The kinetic to compressive energy conversion may be attributed to the momentum difference of the nose 120 being interrupted in translation by the target 100 and the metal disk 190 whose inertial motion is impeded substantially less by the reactive disk 200, which has only a small fraction of the target's mass. The relative motion difference between the nose 120 and the metal disk 190 is represented by the directional arrow 230. The metal disk 190 travels towards the nose 120 along a translation direction corresponding to the trajectory and substantially parallel to the centerline 160.

The purpose of the metal anvils 120, 190 is to compress the reactive disk 200 therebetween. The resulting energy transfer to the reactive disk 200 and the consequential radial extrusion of reactive material, forced through the vent holes 180, applies frictional, shear and/or compression heating to the reactive particles 220. These heated reactive particles 220 transfer thermal energy to the explosive material in the fill region 150 beyond its reaction threshold, thereby initiating the surrounding explosive material therein to explode in the target's proximity.

Alternatively, the metal disk 190 as a steel anvil may be secured at the aft end of the sleeve 170 by a set of discrete shear pins disposed to project radially inward in a plane perpendicular to the centerline 160 distributed with angular separation of e.g., $120°=\frac{2}{3}\pi$ or $90°=\frac{1}{2}\pi$. In lieu of the pins, a frangible obstacle, such as a ceramic or metal lip ring could be employed on the interior cylindrical wall surface of the sleeve 170. As an example, the pins or ring can be composed of a shear-failure-prone metal, e.g., Ti-6 Al-4 V alloy. See "Reverse-Ballistic Impact Study of Shear Plug Formation and Displacement in Ti6Al4V Alloy", W. H. Holt et al., *Journal of Applied Physics*, v. 73 no. 8, pp. 3753-59, Apr. 15, 1993. The pins or ring (not shown) inhibit longitudinal translation of the metal disk 190 within the sleeve 170 during launch or gun-barrel ejection. Upon impact with the target 100, inertial forces of the metal disk 190 shear the pins or shatter the ring, for a suitably determined acceleration load for impact. This releases the metal disk 190 to travel longitudinally through the sleeve 170 at high relative speed towards the reactive disk 200 for initiation of the explosive 150. Such a configuration may enhance handling safety by avoiding contact between the metal disk 190 and the reactive material disk 200 prior to impact with the target 100.

Figure 3:
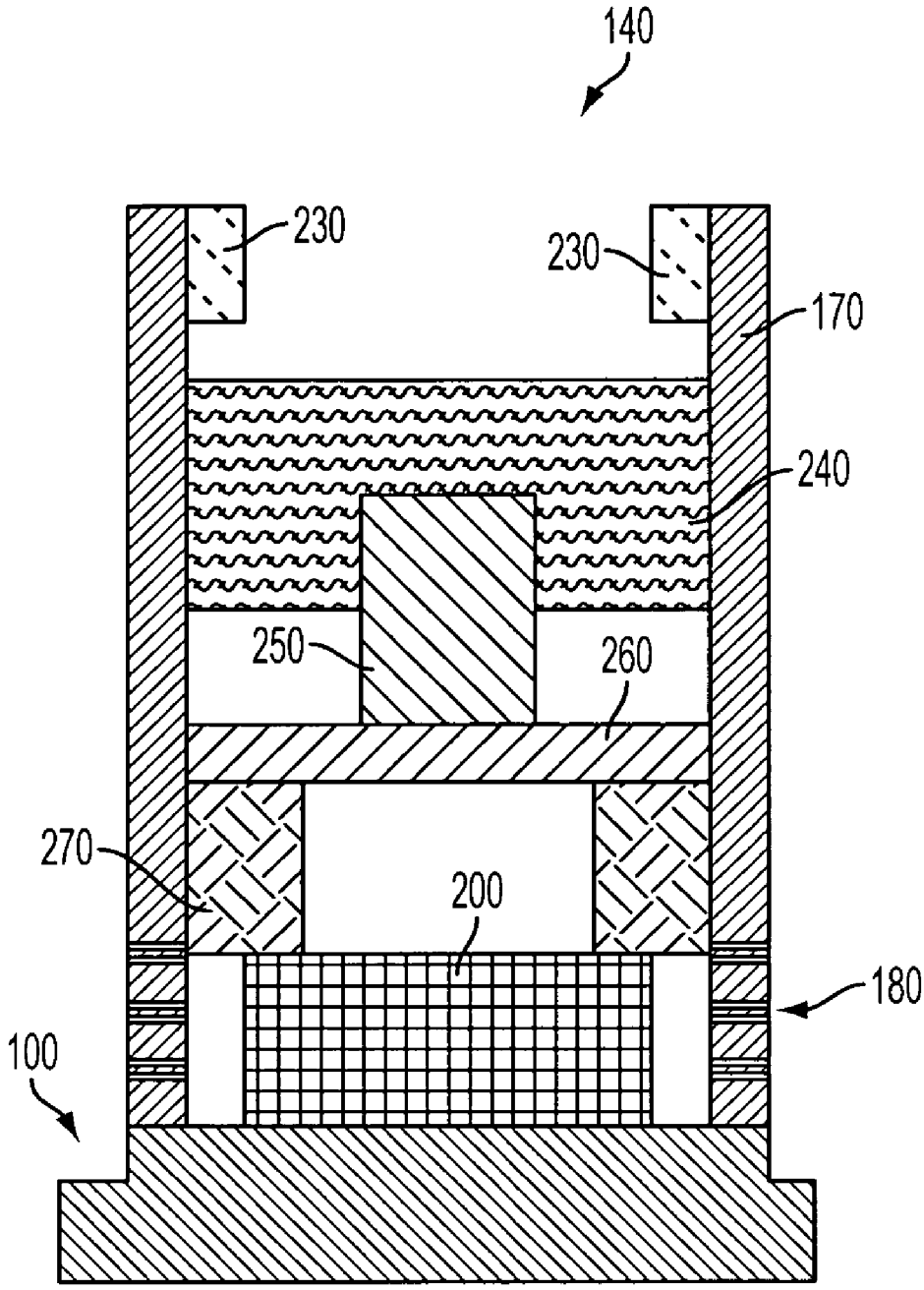
FIG. 3 is an elevation detail view of an initiator in accordance with a second embodiment prior to impact.

FIG. 3 shows a detail of the initiator unit 140 as a second embodiment. An anchor, represented by an inner cylindrical tube 230, or alternatively a set of retainer pins, is disposed behind the anvil components inhibit aft translation along the sleeve 170. Such devices avoid shifting the projectile's center of gravity during launch or gun-ejection due to inertial forces. An anvil 240 with a hard metal dowel 250 may represent (or substitute for) the metal disk 190. The anvil 240 may include a recess in which the dowel 250 may be disposed (as shown), or be integrally connected thereto or else be separately disposed in tandem within the sleeve 170. The dowel 250 may preferably be composed of hard steel, whereas the anvil 240 may be a softer metal.

A shear plate 260 may be disposed forward of the dowel 250, and an annular shim (or spacer) 270 may be disposed between the shear plate 260 and the reactive material disk 200. The shear plate 260 may preferably be composed of titanium, due to its behavior to produce a shear slug (heated by adiabatic shearing) upon being struck by the dowel 250 and driven between the shim 270 towards the reactive material disk 200. The hot shear slug forms a layer of molten metal on its periphery. In this configuration, the reactive material disk 200 is protected from accidental initiation during handling, due to the high acceleration conditions required to produce the molten metal layer on the shear slug and hence conditions suitable for the reactive material to be ignited. Alternatively, an appropriately thick (i.e., rigid) shear plate 260 may be placed in contact with the reactive material disk 200. The hot shear slug can thereby be driven into the reactive material.

Figure 4:
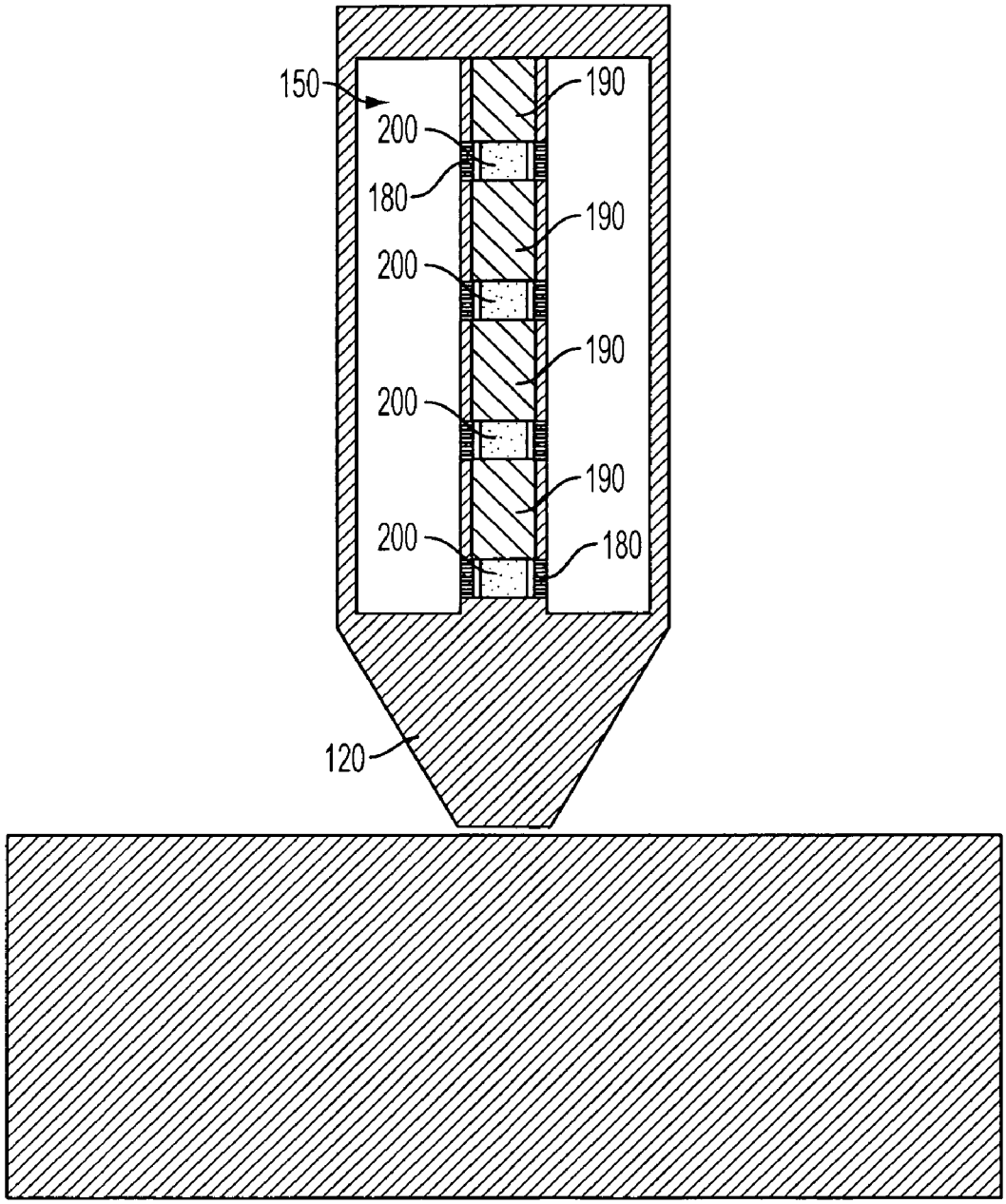
FIG. 4 is an elevation view of an explosive projectile with an initiator in accordance with a third embodiment prior to impact.

As mentioned previously, an alternative third embodiment for the initiator may include a stack of initiator units 140 disposed in tandem series along a longitudinal array for multipoint initiation, as illustrated in FIG. 4. In the multipoint initiation scheme, the sleeve 170 may include several layers of reactive material disks 200 may be sandwiched between metal disks 190. Groups of vent holes 180 disposed longitudinally along the sleeve 170 may be disposed radially adjacent to the reactive disks 200. All the initiators may activate when the target 100 is struck to ignite the explosive in the fill region 150 at multiple initiation sites corresponding to the vent holes 180 for more homogeneous initiation than with a single initiator 140.

Alternatively, a plurality of sleeves 170 may be disposed within the fill region 150. Each of these sleeves 170 may include one or more initiator units 140 (disposed in tandem series). A single sleeve 170 may preferably be aligned coincident with the centerline 160, but may alternatively be offset therefrom. A plurality of sleeves 170 may be disposed in a preferably symmetrical pattern parallel to and around the centerline 160. Another alternative includes rectangular, cruciform, oval or other cross-sectional geometries for the sleeve 170. Yet other alternative geometries may have dimensional or cross-sectional non-uniformity along the length of projectile 110 for the sleeve 170 in which to contain one or more initiator units 140.

Advantages from incorporating a warhead initiator using reactive rather than explosive materials include: (1) classification as a flammable solid, thereby being IM compliant, and (2) reduction in logistics costs rendering safer to handle, store and transport than conventional initiators.

Figure 5:
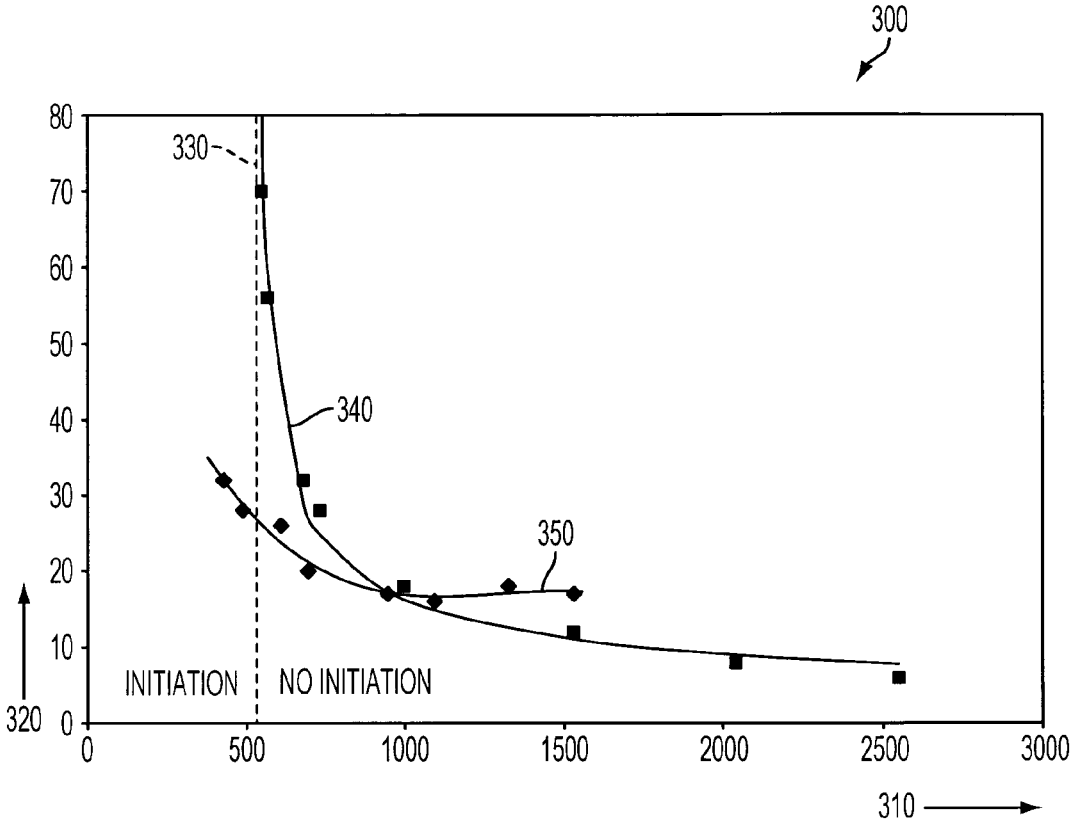
FIG. 5 is a graphical view of a plot comparing time to first light versus velocity for the initiator material.

FIG. 5 shows the results from experiments performed at Naval Surface Warfare Center-Dahlgren Division to compare confined and unconfined reactive material samples as a plot 300. A solid mixture of powdered aluminum and PTFE was pressed into sample disks. Sample disks (confined by steel anvils on either end and struck by a launched steel disk) reacted (to produce light) at a much lower impact velocity than unconfined sample disks of the same reactive material similarly struck.

The plot 300 graphically compares launch velocity (in ft/sec) of the steel disk as the abscissa 310 and the time (in μsec) to initiation (as determined by first light observed) as the ordinate 320. The initiation velocity of 531 ft/sec represents a threshold line 330 determined by Los Alamos National Laboratory above which direct impact fails to initiate. A first curve 340, based on solid squares, shows direct impact results asymptotically approaching the threshold. A second curve 350, based on solid diamonds, crosses the threshold 330 reaches into the initiation region on the left.

The initiator 140 may be integrated into the projectile 110 as assembled to exploit advantages derived from the reduced hazard from un-commanded initiation as compared to a conventional initiator equipped with explosives. Alternatively, the initiator 140 may be stored separately for field assembly with the projectile 110 into the shell 170, as desired.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An initiator for a munitions device that contains an explosive within a case, the device having a trajectory direction, the device intended to strike a target substantially along the direction, the initiator comprising:

a sleeve within the case and adjacent to the explosive, said sleeve defining an initiator interior aligned substantially parallel to the trajectory direction, said sleeve including at least one orifice that extends therethrough between the explosive and said interior;

an initiation pellet within said interior, said pellet being composed of a reactive material that chemically responds as a non-explosive to kinetic and thermal stimuli, said pellet being disposed adjacent said orifice;

a first anvil disposed transverse to said interior and forward of said pellet; and a second anvil disposed within said interior behind of said pellet, wherein said second anvil translates within said interior towards said first anvil substantially along the trajectory direction in response to the device striking the target, said pellet discharges particles through said orifice into the explosive in response to said second anvil translating towards said first anvil.

2. The initiator according to claim 1, wherein said sleeve possesses a longitudinal centerline substantially parallel to the trajectory direction.

3. The initiator according to claim 1, wherein said sleeve is disposed within the explosive.

4. The initiator according to claim 1, wherein said first anvil is within said interior behind a nose of the device, the nose disposed forward of the case.

5. The initiator according to claim 1, wherein said sleeve further comprises:

a second pellet disposed behind said second anvil, said second pellet being composed of said reactive material, a third anvil disposed behind said second pellet, wherein said sleeve includes at least one second orifice that extends therethrough between the explosive and said interior, said second pellet being disposed adjacent said second orifice, said third anvil translates towards said second anvil substantially along the trajectory direction in response to the device striking the target, and said second pellet discharges additional particles through said second orifice into the explosive in response to said third anvil translating towards said second anvil.

6. The initiator according to claim 1, further comprising:

a shear plate disposed behind said pellet within said sleeve;

a shim disposed behind said shear plate within said sleeve; and a dowel disposed within said sleeve between said behind said shim and said second anvil;

wherein said second anvil pushes said dowel to press against said shear plate in response to the device striking the target, thereby changing a portion of said shear plate into a shear slug having a molten layer that translates through said shim to initiate said pellet for discharging said particles, the molten layer being formed on a surface that faces said initiation pellet.

7. The initiator according to claim 1, wherein said initiator interior includes a void and an anchor, said void being aligned substantially parallel to the trajectory direction, said anchor restraining said second anvil from translating in said initiator interior at least until the device strikes the target.

8. The initiator according to claim 1, wherein said reactive material is a solid mixture of powdered aluminum and one of polytetrafluoroethylene and another fluoropolymer.

9. The initiator according to claim 1, wherein said reactive material is a powdered mixture of powdered aluminum and one of polytetrafluoroethylene and another fluoropolymer.

10. The initiator according to claim 1, wherein said reactive material is a thermite mixture of powdered metal and metal oxide.

11. An explosive munitions device having a trajectory direction and intended to strike a target along said direction, the device comprising:

a case including a nose;

an explosive contained within said case behind the nose;

an initiator including:

a sleeve adjacent to the explosive, said sleeve defining an initiator interior aligned substantially parallel to the trajectory direction, said sleeve including at least one orifice that extends therethrough between said explosive and said interior;

an initiation pellet within said interior, said pellet being composed of a reactive material that chemically responds as a non-explosive to kinetic and thermal stimuli, said pellet being disposed adjacent said orifice;

a first anvil disposed transverse to said interior and forward of said pellet; and a second anvil disposed within said interior behind of said pellet, wherein said second anvil translates towards said first anvil substantially along the trajectory direction in response to the device striking the target, and said pellet discharges particles through said orifice into said explosive in response to said second anvil translating towards said first anvil.

12. The device according to claim 11, wherein said first anvil is disposed within said interior behind said nose.

13. The device according to claim 11, wherein said nose represents said first anvil.

14. The device according to claim 11, wherein said sleeve possesses a longitudinal centerline substantially parallel to the trajectory direction.

15. The device according to claim 11, wherein said sleeve is disposed within said explosive.

16. The device according to claim 11, wherein said first anvil is within said interior behind said nose.

17. The device according to claim 11, wherein said sleeve further comprises:

a second pellet disposed behind said second anvil, said second pellet being composed of said reactive material, a third anvil disposed behind said second pellet, wherein said sleeve includes at least one second orifice that extends therethrough between said explosive and said interior, said second pellet being disposed adjacent said second orifice, said third anvil translates towards said second anvil substantially along the trajectory direction in response to the device striking the target, and said second pellet discharges additional particles through said second orifice into said explosive in response to said third anvil translating towards said second anvil.

18. The device according to claim 11, wherein said reactive material is a solid mixture of powdered aluminum and one of polytetrafluoroethylene and another fluoropolymer.

19. The device according to claim 11, wherein said reactive material is a powdered mixture of powdered aluminum and one of polytetrafluoroethylene and another fluoropolymer.

20. The device according to claim 11, wherein said reactive material is a thermite mixture of powdered metal and metal oxide.

* * * * *